US008238592B2

(12) United States Patent
Norgaard et al.

(10) Patent No.: US 8,238,592 B2
(45) Date of Patent: Aug. 7, 2012

(54) METHOD FOR USER INDVIDUALIZED FITTING OF A HEARING AID

(75) Inventors: Peter Magnus Norgaard, Varlose (DK); Mike Lind Rank, Farum (DK); Jakob Nielsen, Copenhagen (DK)

(73) Assignee: Widex A/S, Lynge (DK)

( * ) Notice: Subject to any disclaimer, the term of this patent is extended or adjusted under 35 U.S.C. 154(b) by 246 days.

(21) Appl. No.: 12/634,220

(22) Filed: Dec. 9, 2009

(65) Prior Publication Data

US 2010/0086143 A1 Apr. 8, 2010

Related U.S. Application Data

(63) Continuation-in-part of application No. PCT/DK2007/050072, filed on Jun. 13, 2007.

(51) Int. Cl.
*H04R 25/00* (2006.01)

(52) U.S. Cl. ..... 381/312; 73/585; 600/559

(58) Field of Classification Search ..... 381/60, 381/58, 312, 314, 23.1; 73/585; 60/559
See application file for complete search history.

(56) References Cited

U.S. PATENT DOCUMENTS 4,548,082 A * 10/1985 Engebretson et al. ..... 73/585
6,876,750 B2 * 4/2005 Allred et al. ..... 381/314
2004/0190737 A1 9/2004 Kuhnel et al.
2007/0076909 A1 * 4/2007 Roeck et al. ..... 381/312
2010/0254551 A1 * 10/2010 Aoki et al. ..... 381/312

FOREIGN PATENT DOCUMENTS

EP 1708543 A1 10/2006
WO 9919779 A1 4/1999
WO 2006136616 A2 12/2006
WO 2007045276 A1 4/2007

OTHER PUBLICATIONS

International Search Report Mar. 14, 2008 for PCT/DK2007/050072 (WO2008/151625).
International Preliminary Report on Patentability Sep. 4, 2009.

* cited by examiner

*Primary Examiner* — Vivian Chin
*Assistant Examiner* — Con P Tran
(74) *Attorney, Agent, or Firm* — Sughrue Mion, PLLC

(57) ABSTRACT

A method for user individualized fitting of a hearing aid comprises: Performing an initial fitting (101) of the hearing aid in an interactive session between the hearing aid user and a fitter, monitoring, for a predetermined period after the initial fitting, the hearing aid user's choice of at least some of the settings of the hearing aid and storing the results of the monitoring in a log. The log is transmitted (108) to the fitter for evaluation (109) of preferred user settings. If the evaluation reveals that the preferred user settings are acceptable, the fitting of the hearing aid is finalized (105) accordingly.

10 Claims, 2 Drawing Sheets

METHOD FOR USER INDVIDUALIZED FITTING OF A HEARING AID

RELATED APPLICATIONS

The present application is a continuation-in-part of application No. PCT/DK2007050072, filed on Jun. 13, 2007, in Denmark and published as WO2008151625 A1.

BACKGROUND OF THE INVENTION

1. Field of the Invention

The present invention relates to a method of fitting of a hearing aid.

2. Prior Art

Before a hearing aid user starts using his or her hearing aid, or hearing aids if he needs two, the hearing aid must be fitted to suit the hearing deficiency of the hearing aid user. Normally, this fitting takes place in an interactive session between the hearing aid user and a fitter, typically an audiologist, at the audiologist's clinic.

During the session, the audiologist attempts to determine the users hearing deficiency and adjusts the adjustable parameters in the hearing aid to fit the determined deficiency. The hearing aid as such relies on so many adjustable parameters that it will be an impossible task for anyone, even the skilled audiologist, to adjust them all. Instead, a fitting software accompanying each product family is used in conjunction with a computer and possibly a control box for fitting the hearing aid.

In this respect, a central functionality incorporated in modern hearing aids is an amplitude compression of the microphone signal that can account for the degradation in the compression performed in the auditory system of a hearing impaired person. The compression can be varied over the frequency range in accordance with the person's hearing loss. Also, the effective compression ratio can be varied with signal magnitude within a limited frequency band.

As a specific example of the reduced parameter set, the fitting software does not allow an audiologist to freely set the compression curves. Instead, simpler fitting rules are used such that basic compression curves are selected in accordance with a few simple measurements on the hearing impaired person. An example is an audiogram, which specifies the hearing threshold over frequency. Subsequently, this basic setting can be fine-tuned, e.g. based on how the person with hearing impairment perceives the amplification at soft sounds or loud sounds or whether there appears to be a noticeable problem with the mutual balance between the hearing aids, if he has two (binaural fitting).

One problem relating to the hearing aid fitting is that in this interactive session it can be quite challenging—even for a highly skilled audiologist—to immediately make a perfect hearing aid fitting. Sound perception is very subjective, and also it may take quite a while to get used to the sound of a new hearing aid. In addition to this, the fitting situation is typically quite different from the environment that the user is usually subject to. Thus, if the initial fitting made by the audiologist is not appropriate, this may not become evident until the user has become accustomed to his or her new hearing aid or new set of hearing aids by trying them for a longer period of time in familiar situations.

SUMMARY OF THE INVENTION

On this basis, it is preferred feature of the present invention to provide a fitting method, with which these problems are overcome.

According to the present invention this object is achieved by a method for user fitting of a hearing aid, said method comprising: performing an initial fitting of the hearing aid in an interactive session between a hearing aid user and a fitter, for a predetermined period after said initial fitting, allowing the hearing aid user to adjust the settings of the hearing aid, monitoring the hearing aid user's choice of at least some of the settings and storing the results of the monitoring in a log, transmitting said log to the fitter for evaluation of preferred user settings, evaluating said preferred user settings, and if said evaluation reveals that the preferred user settings are acceptable, finalising the fitting of the hearing aid accordingly, or if said evaluation reveals that the preferred user settings are not acceptable, performing an action selected among finalising the settings of the hearing aid in accordance with the initial fitting, performing a new interactive session between the user and a fitter, and monitoring for a new predetermined period, the user's choice of at least some of the settings of the hearing aid and storing the results of the monitoring in a log.

With this method it becomes possible to fit the hearing aid to suit the user's actual situations and the way he uses his hearing aid, while taking into account the user's learning process when getting a new hearing aid and getting accustomed with it. If it turns out that the time period set for the user is insufficient, the time period may be extended. Furthermore, if the user turns out to use his hearing aid in an unexpected way, i.e. in a way or in listening situations differing substantially from the initial fitting, the fitting could be repeated and the user given a new time period to get accustomed to the hearing aid.

According to a preferred embodiment of the invention, the method further comprises the transmission of a code to the hearing aid, said code indicating whether the settings of the hearing aid are to be finalized in accordance with the preferred user settings, the settings of the hearing aid are to be finalized in accordance with the initial fitting, a new interactive session between the user and the fitter is to be performed, or the user's choice of at least some of the settings of the hearing aid are to be monitored for a new predetermined period. This allows for easy finalising of the settings of the hearing aid, which may even be performed in a remote session with the fitter, without the user actually having to go to the audiologist's.

Thus, according to a specifically preferred embodiment of the invention the hearing aid is a network enabled hearing aid, and the log is transmitted to the fitter by means of a data network for evaluation of preferred user settings. Likewise, according to a further preferred embodiment, said finalising code is also transmitted via the data network.

According to yet a further preferred embodiment of the invention, said data network comprises the Internet. Internet access is getting widely available and thus allows a large share of hearing aid users to perform the finalising of their hearing aids from home in a remote session with the audiologist.

According to a specific embodiment of the invention, said settings comprise the maximum gain in at least one frequency band. In this way it becomes possible to identify whether the hearing aid user has a general need for higher or lower sound levels.

However, as hearing losses are typically non-linear, it is according to a further preferred embodiment preferred that said settings comprise the compression ratio in at least one frequency band, thereby also allowing for a higher or lower maximum sound level.

According to yet another preferred embodiment, said settings comprise the user's choice of programmer. By logging information about the user's choice of programmers, information can be gained about, which programmers are used most. If a programmer is never used, e.g. because the user is never in a listening situation, for which the programmer is suitable, or because number of selectable programmers exceeds the mental capacity of the user, the programmer may be removed from the selectable programmers, or replaced with a more suitable one. Thus, according to yet a further preferred embodiment, said finalising comprises removal of unused programmers.

According to yet a further embodiment of the invention, said hearing aid is finalized according to the initial fitting, if said period expires without any log file having been sent to the fitter. This relieves the user from the task of contacting the audiologist or transmitting results to him if he is satisfied with his hearing aid.

BRIEF DESCRIPTION OF THE DRAWINGS

The invention will now be described in greater detail based on preferred exemplary embodiments and the drawings. In the drawings.

DETAILED DESCRIPTION OF THE INVENTION

Figure 1:
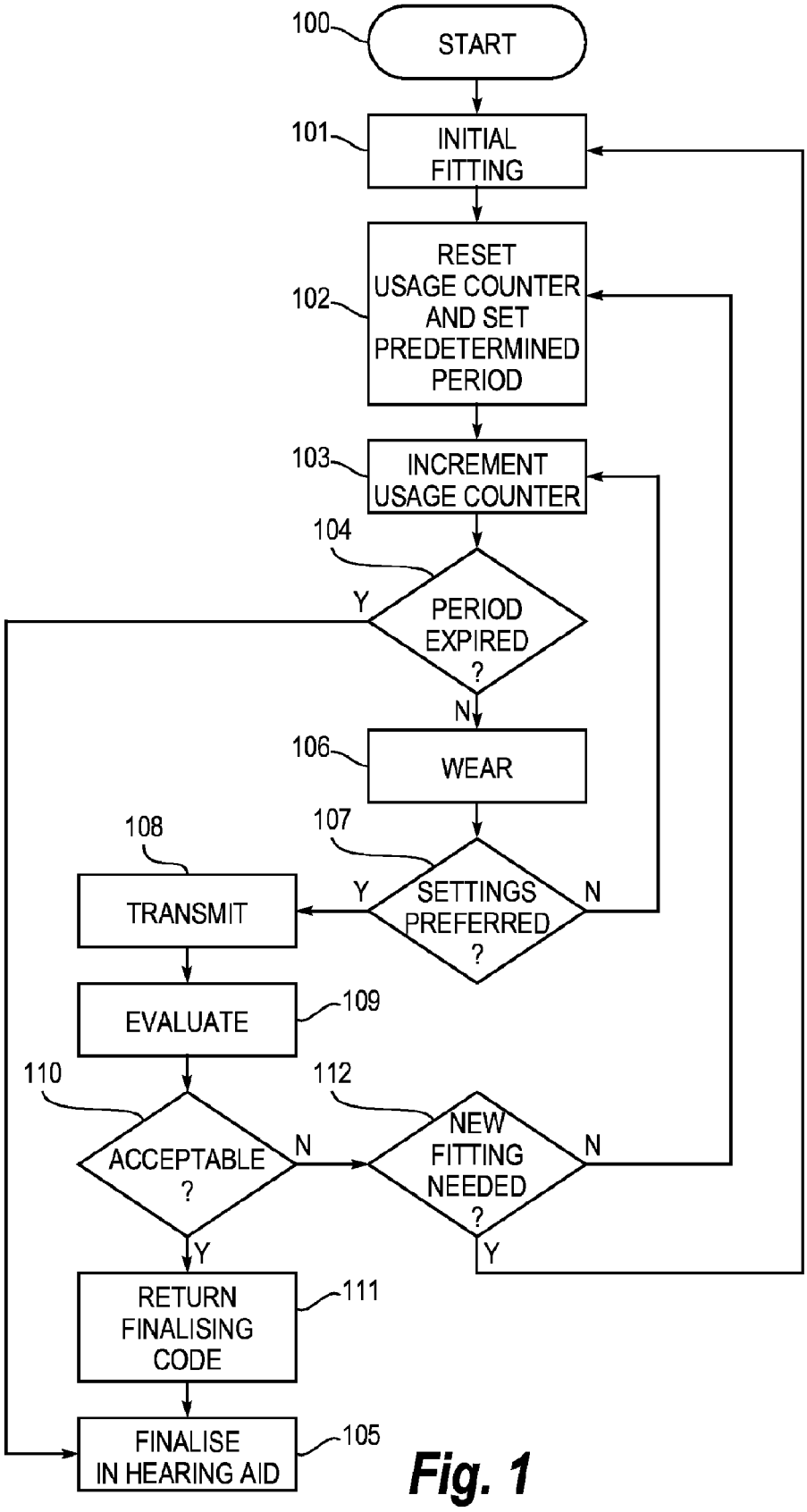
FIG. 1 illustrates a flow chart illustrating a preferred embodiment of method of the invention.

Turning first to FIG. 1, a flow chart illustrating schematically an embodiment of the method according to the invention, is shown.

In FIG. 1, the oval 100 indicates the starting point of the method.

In box 101 the initial fitting takes place. This is normally done in an interactive session, in which the fitter, who is typically an audiologist or the like, determines the hearing loss of the wearer. Based on the determined hearing loss, and an interactive exchange of information between the fitter and the user, the fitter adjusts settings of the hearing aid to match needs of the user. Such settings may include the maximum output level from the hearing aid, the gain in various frequency bands and for various sound levels, as well as compression factors in various frequency bands.

After the initial fitting, a predetermined period is fixed in box 102 and a variable Usage_counter is reset. The predetermined period determines a period, during which the hearing aid user is allowed to adjust the settings of the hearing aid and otherwise get accustomed to the hearing aid. Information about the predetermined time period is preferably stored in the hearing aid, e.g. in an EPROM, or in a closely associated device such as a wireless remote control for the hearing aid. Also, information about limits, within which the user is allowed to adjust the settings, is preferably stored. This could be information regarding the maximum gain, or maximum output level, thus preventing the hearing aid user from adjusting the settings of the hearing aid to something potentially harmful to his already impaired hearing. The duration of the predetermined time period is typically selected by the fitter. This will be discussed further below.

To keep track of whether the predetermined time period has elapsed or not, the variable Usage_counter is incremented in box 103. The skilled person will know that this is only an example, and realize that other methods of keeping track of time will be possible, e.g. using a decremental counter counting down to zero from a value corresponding to the predetermined time period. Preferably only the actual hours of use are taken into account. This is mainly because keeping track of time while the hearing aid is switched off is unnecessarily complicated, in particular when taking into account that relevant data about the use and the settings are only gathered when the hearing aid is in use, i.e. switched on.

In either case, in box 104 a check is made as to whether the predetermined time period has expired. If so, the settings of the hearing aid are finalized in box 105, preferably using the settings from the initial fitting. It should be emphasized that this is only a preferred action. The skilled person will realize that other actions are possible upon expiry of the time limit, including alerting the user, disabling the hearing aid, issuing repeated reminders that the fitter should be contacted etc.

If the predetermined time period has not expired, the user wears his hearing aid in box 106, using the various programmers and possibly modifying the settings, such as gain and/or compression rate. Data reflecting the use and the modified settings are stored in a log file. Since not very many parameters of the settings are adjustable for the user, this could be accomplished using only a few buttons on the remote control, or even just switches on the hearing aid itself, rather than using a specific control box or an externally connected Personal Computer (PC), as would the fitter.

In box 107, a check is performed as to whether the user accepts the settings and wishes to transmit the log file to a fitter, thus indicating that the current settings are preferred. If not, the wearing of the hearing aid is continued in box 106, the time remaining of the predetermined time period being reduced accordingly in box 103. The skilled person will realize, that the action of indicating that the settings are preferred, and that the user is ready to transmit the log file to the fitter, needs not necessarily be provided as a part of the loop 103, 104, 106, 107, but could be in the form of an interrupt provided by the user pressing a specific button, e.g. on the remote control, or by connecting his hearing aid to a computer.

If, on the other hand, the check in box 107 or an interrupt reveals that the current settings are preferred, the log file is transmitted to the fitter in box 108. In the preferred embodiment the hearing aid is network enabled, and this is done from home by the user using an internet connection, allowing him to establish real time contact with the fitter. It may, however, also be done using an email or the like to transmit the log file to the fitter. The latter has the advantage that it may be done at any time suitable for the user, irrespective of the availability of the fitter, i.e. so that the fitter and the user need not be on-line simultaneously. This would also be the case if, according to another option, the information is uploaded to a database on a server to which both the fitter and the user has access.

Irrespective of whether this session with the fitter is in real time or not, further data could also be transmitted. Such data include recordings of sound situations made by the user under circumstances where he is not satisfied with the performance of the hearing aid. This would then aid the fitter in identifying problems in the initial settings. Also, self test data indicating the performance of the hearing aid could be transmitted, thus allowing the fitter to verify that the hearing aid is actually functioning correctly, e.g. that the sound output is not blocked by cerumen. The data could be part of the log file too, or be sent as separate files.

Having received the log file, the fitter may, in box 109, evaluate the preferred settings and decide whether it is acceptable to allow the user to use these settings. The evaluation of the settings by the fitter could inter alia, involve the following points:

Are the settings potentially harmful to the users hearing?

Has enough time been spent on the task?

Does the user fine-tuning appear to be reasonable?

If the user setting is reasonable, should the setting be reflected in other programs (like special listening programs for music, TV, or tele coil programs)?

Should more time be allowed for the user, but with a widened parameter set; for example, should a higher maximum gain be permitted?

If the user fine-tuning is a matter of selecting a favourite setting out of several possible settings, should a second iteration be allowed with a new selection of possible settings?

Does a test for assessing speech intelligibility in quiet and in noise show sufficiently improved results?

If, in box 110, the settings are found to be acceptable, the fitter returns an appropriate finalising code to the hearing aid in box 111, and the hearing aid proceeds to box 105 to finalize the settings. Like the log file, this code may also be sent via an email, so that the fitter and the user need not be on-line simultaneously.

Thus, the log file could be sent in the evening by the user, box 108, and looked at the next day by the fitter for evaluation, box 109, and acceptance, box 110, then returning a finalising code, box 111. In this respect, it should be noted that the finalising may apply to only some of the user settings.

If, in box 110, the fitter finds that the settings are not acceptable, a further decision has to be taken in box 112. In box 112, a decision as to whether a completely new fitting is to be performed is made. In that case the user has to come to the fitter for a new fitting session, box 101. After this new fitting session in box 101 the method according to the invention may be repeated.

However, it may also be that the evaluation reveals that the settings preferred by the user are almost acceptable, and that an extended trial period is appropriate, in that case a new predetermined period is set in box 102. This could be case where e.g. compression and gain settings are acceptable for some programmers, but not for others, or where uncertainty exists as to whether the user actually needs a programmer or not. The duration of this new predetermined period may be the same as the preceding one, or it may be shorter or longer, depending on what the fitter finds is appropriate. At this stage it would also be possible to alter the parameters and limits within which the user may modify the settings of the hearing aid.

As to the duration of the predetermined time period, it may depend on how the method is implemented. If, as preferred, the hearing aid is initially fitted in a fitting session at the audiologist's and the hearing aid user goes home to get accustomed to his new hearing aid, an appropriate duration would e.g. be 14 days or a month.

However, according to another, currently less preferred implementation of the method, the time period could be a short period, of e.g. a few hours, in which the hearing aid user could borrow a fitting tool or a suitably equipped Personal Computer and sit at the audiologist's trying out his new hearing aid. Possibly, this could happen in cooperation with other hearing aid users at the audiologist's allowing them to discuss with each other and get accustomed to and acquainted with their new hearing aids. After a few hours trying out the hearing aid in close discussion with others and using a fitting box at the audiologist's, the fitter could evaluate the new settings of the hearing aid, box 109, and finalize these, boxes 110, 111 and 105. On the other hand, if after the few hours the user has appropriate settings, the fitter could decide, box 112, that a prolonged period is needed for the user to find out whether he needs all programmers, and set a new predetermined period in box 102, before the user leaves the premises. Later, during the new predetermined period the settings may then be finalized from home by the user using his own computer as explained above. Thus, the user does not have to go to the audiologist's again. Consequently, the method according to the invention saves the user from time consuming trips and costly transportation that would otherwise be involved in getting the hearing aid fitted better or fine-tuned to his specific purposes.

In particular in connection with the fitting session with other people at the audiologist's discussing with each other and getting accustomed to and acquainted with the new hearing aids but also at home, a Personal Computer with appropriate software can be used to assess how the new settings influence the speech intelligibility. In particular, the PC software can be used for assessing how the new setting influences speech intelligibility in quiet as well as noisy situations compared with the initial hearing aid setting. This might occur according to a multiple choice test, a forced choice listening test or other tests. The test may take place by using a set of speakers attached to the user's Personal Computer, but a better solution may be to stream sound directly to the hearing aids to reduce sensitivity to environmental sounds and to avoid a difficult calibration of the PC speakers.

Besides the fine-tuning relating to the compression, i.e. the compensation for the hearing loss, it is also possible to let the user influence parameters related to listening comfort. Examples can be the amount of noise reduction, e.g. by which amount is a noise reduction system allowed to reduce the signal energy in noisy situations. Often, there can be a dilemma between listening comfort and speech intelligibility in noise, and it may take some practical experiments for the user to select the preferred weighting of the two contradictory desires.

Another fine-tuning parameter that the user might want to modify would be the limit frequency above which sound signals are transposed. If the hearing aid user suffers from a complete loss of hearing ability in a frequency band, the audible content of that band may be transposed, i.e. shifted to another frequency band where it would be audible to the user. Typically the higher frequencies above a specified limit are shifted down. If this leads to too much information content in the audible bands, the user might want to change the limit frequency to reduce the information in the audible band.

Figure 2:
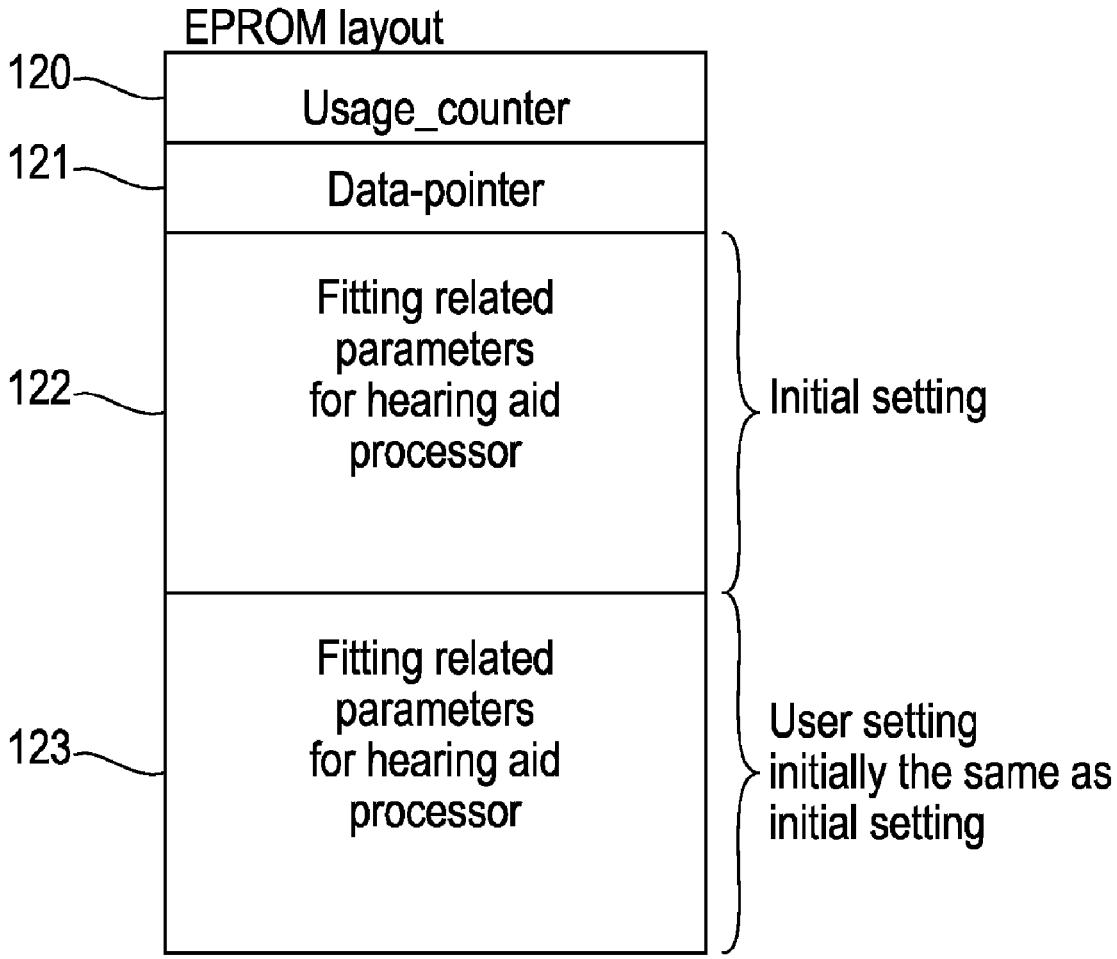
FIG. 2 illustrates the layout of an EPROM used in a hearing aid for the use with the method of FIG. 1.

In FIG. 2, a schematic example of how the initial settings and the user settings could be stored in the hearing aid is shown in the form of a memory map layout of an EPROM in the hearing aid. The skilled person will realize that this is only an example and that it could be realized in many other ways. The EPROM comprises an area 120 holding a variable, Usage_counter, which forms part of the log file, thus allowing the fitter to verify that the hearing aid has been used in a sufficiently long period of time to allow an appropriate evaluation of the user settings. The EPROM furthermore has an area 121 holding a parameter, Data-pointer, pointing to one of two areas 122, 123 holding fitting relating parameters for the hearing aid processor. In the illustrated example, the area 122 holds the fitting related parameters corresponding to the initial settings as established during the initial fitting session in box 101 of FIG. 1. The area 123 on the other hand holds the fitting related parameters corresponding to user settings as established during the user's own modifications of the hearing aid settings during the predetermined period. Initially these settings may simply correspond to the initial settings, as established during the fitting in box 101 of FIG. 1. These settings also form part of the log file.

The initial settings and the user settings may be available side-by-side as different listening programs allowing the user to evaluate his own user settings relative to the initial settings.

Alternatively, only the user settings are used initially while the initial settings exist as a backup solution. This is handled by letting the parameter Data-pointer point out this data block as the one used.

In the first solution, if the variable Usage_counter exceeds a specified threshold value, e.g., 14 days or a month, the user settings disappear from the list of possible listening programs. In the second solution, if the variable Usage_counter exceeds a specified threshold value, the Data-pointer is set to point out the initial setting area 122 as the one used.

If the hearing aid or an associated remote unit has been connected to the internet and fitting information has been uploaded to the audiologist, the audiologist can return a code which can permanently set the Data-pointer and disable the Usage_counter.

Alternatively, the fitter can also set up new limits for tuning or new parameter sets to try out and reset the Usage-Counter or increase the threshold it is compared to in box 102 of FIG. 1.

A similar solution is possible without writing data in EPROM. Instead the controller box transmits data to RAM registers in the hearing aid processor overwriting data read from the EPROM after power-up. The experimental solution then exists in a volatile fashion and disappears on program change or power-down.

In the above, the invention has been described based on exemplary embodiments. The skilled person, however, will realize that these are only examples and that numerous modifications may be made without departing from the scope of invention as expressed in the appended claims. E.g. the content of the log file could be extended with respect to the preferred embodiments.

The invention claimed is:

1. A method for user fitting of a hearing aid, said method comprising:

performing an initial fitting of the hearing aid in an interactive session between a hearing aid user and a fitter to establish settings for the hearing aid, for a predetermined period after said initial fitting, allowing the hearing aid user to adjust the settings of the hearing aid, monitoring the hearing aid user's choice of at least some of the settings and storing said monitored choices in a log, transmitting said log to the fitter for evaluation of preferred user settings, evaluating said preferred user settings, and if said evaluation reveals that the preferred user settings are acceptable, finalising the fitting of the hearing aid accordingly, or if said evaluation reveals that the preferred user settings are not acceptable, performing an action selected among:

finalising the settings of the hearing aid in accordance with the initial fitting, performing a new interactive session between the user and a fitter, and monitoring for a new predetermined period, the user's choice of at least some of the settings of the hearing aid and storing the results of the monitoring in a log.

2. The method according to claim 1, comprising the transmission of an appropriate code to the hearing aid, said code indicating whether the settings of the hearing aid are to be finalised in accordance with the preferred user settings, the settings of the hearing aid are to be finalised in accordance with the initial fitting, a new interactive session between the user and the fitter is to be performed, or the user's choice of at least some of the settings of the hearing aid are to be monitored for a new predetermined period.

3. The method according to claim 2, wherein the hearing aid is a network enabled hearing aid and, wherein said code and said code are transmitted to the fitter via the data network.

4. The method according to claim 1, wherein the hearing aid is a network enabled hearing aid, and wherein the log is transmitted to the fitter for evaluation of the user's choice of settings by means of a data network.

5. The method according to claim 4, wherein said data network comprises the internet.

6. The method according to claim 1, wherein said settings comprise the maximum gain in at least one frequency band.

7. The method according to claim 1, wherein said settings comprise the compression ratio in at least one frequency band.

8. The method according to claim 1, wherein said settings comprises the user's choice of programme.

9. The method according to claim 8, wherein said finalising comprises removal of unused programmes.

10. The method according to claim 1, wherein said hearing aid is finalised according to the initial fitting, if said period expires without any log file having been sent to the fitter.

* * * * *